US012465833B2

(12) United States Patent
Grasso et al.

(10) Patent No.: US 12,465,833 B2
(45) Date of Patent: Nov. 11, 2025

(54) STARTING BLOCK OR BASE PLATE WITH A SUPPORTING LEDGE DEVICE FOR A START OF A BACKSTROKE RACE

(71) Applicant: SWISS TIMING LTD, Corgémont (CH)

(72) Inventors: Christophe Grasso, Bienne (CH); Frederic Choffat, Alle (CH); Fabio Filieri, Reconvilier (CH); Camille Mairot, Le Valdahon (FR)

(73) Assignee: SWISS TIMING LTD, Corgemont (CH)

( * ) Notice: Subject to any disclaimer, the term of this patent is extended or adjusted under 35 U.S.C. 154(b) by 661 days.

(21) Appl. No.: 17/898,790

(22) Filed: Aug. 30, 2022

(65) Prior Publication Data

US 2023/0117056 A1 Apr. 20, 2023

(30) Foreign Application Priority Data

Oct. 14, 2021 (EP) ..... 21202606

(51) Int. Cl.
*A63B 69/12* (2006.01)
*A63B 5/10* (2006.01)
*E04H 4/14* (2006.01)

(52) U.S. Cl.
CPC ..... *A63B 69/12* (2013.01); *A63B 5/10* (2013.01); *E04H 4/14* (2013.01); *A63B 2208/03* (2013.01); *A63B 2244/20* (2013.01)

(58) Field of Classification Search
CPC ..... A63K 3/02; A63K 3/0233; A63K 69/12; A63B 5/10; A63B 69/12; E04H 4/14; E04H 4/144
USPC ..... 434/254; 482/26, 55; 472/128
See application file for complete search history.

(56) References Cited

U.S. PATENT DOCUMENTS

| | | | | |
|---|---|---|---|---|
| 9,421,407 | B2 * | 8/2016 | Colletto | A63B 5/10 |
| 2015/0290553 | A1 * | 10/2015 | Stockinger | A63K 3/023 4/496 |
| 2016/0256721 | A1 * | 9/2016 | Abe | A63B 31/00 |

FOREIGN PATENT DOCUMENTS

| | | | | |
|---|---|---|---|---|
| AU | 2019250208 | A1 * | 5/2020 | E04H 4/14 |
| CA | 2968020 | A1 * | 1/2015 | |
| CH | 719058 | A2 * | 4/2023 | A63K 3/02 |
| CN | 212651310 | U * | 3/2021 | |
| CN | 218553040 | U * | 3/2023 | |
| EP | 3669953 | A1 * | 6/2020 | A63B 5/10 |

(Continued)

OTHER PUBLICATIONS

Website sale of S-Line Deck Level Backstroke Starting Ledge.*
Website sale of Stationary Backstroke Start Wedge.*
European Search Report for EP 21 20 2606 dated Mar. 9, 2022.

*Primary Examiner* — Joseph S Del Sole
(74) *Attorney, Agent, or Firm* — Sughrue Mion, PLLC

(57) ABSTRACT

A starting block (1) including a supporting ledge device (10) for a start of a backstroke race. The supporting ledge device is at least partially integrated into the starting block. The supporting ledge device includes a support ledge (13) on which at least one foot of a swimmer can be supported before the start of a backstroke race. The support ledge is held from within a base (9) or a base plate of the starting block by fastening elements (11). Two flexible fastening elements in the form of straps are respectively connected to the two ends of the support ledge and to return means within the starting block at ends opposite the fixation to the support ledge.

20 Claims, 5 Drawing Sheets

(56) References Cited

FOREIGN PATENT DOCUMENTS

| | | | | | |
|---|---|---|---|---|---|
| EP | 4166200 | A1 | * | 4/2023 | ..... E04H 4/14 |
| JP | 2016160657 | A | * | 9/2016 | ..... A63B 5/10 |
| JP | 3207110 | U | * | 10/2016 | |

* cited by examiner

STARTING BLOCK OR BASE PLATE WITH A SUPPORTING LEDGE DEVICE FOR A START OF A BACKSTROKE RACE

CROSS-REFERENCE TO RELATED APPLICATIONS

This application claims priority to European Patent Application No. 21202606.6 filed Oct. 14, 2021, the entire contents of which are incorporated herein by reference.

FIELD OF THE INVENTION

The invention relates to a starting block or a base plate intended for fixing the starting block to the ground with a supporting ledge device for a backstroke race start.

BACKGROUND OF THE INVENTION

For competitive swimming, starting blocks are provided, respectively disposed at each race lane, 10 lanes often being present. Each swimming starting block is particularly adapted to the type of swim race during a competition. The starting blocks are all disposed in a line along one side of the pool. The swimmer is supported on an upper platform of the starting block for a crawl, breaststroke or butterfly stroke type. For these stroke types, the swimmer can be supported on a front part of the starting block, or also on an inclined push-off plane disposed towards the rear of the platform.

For a backstroke-type race, however, each swimmer must first enter the water and position himself/herself near a contact plate used for the race finish. This contact plate is mounted against a vertical wall of the pool below the starting block. For this type of backstroke race, the swimmer can manually adjust a supporting ledge device so as to place his/her feet on a supporting ledge plate in the water before the start. Moreover, the starting block can further comprise, on the front, a horizontal bar and two vertical bars connected to the end of the horizontal bar and fixed to the base of the starting block. This arrangement of bars forms a stirrup structure allowing the swimmer to hold on with his hands while having his/her feet supported by the supporting ledge plate in order to get in position before the start of the race.

FIG. 1 shows a starting block 1 with a supporting ledge device 10 for a backstroke race. The starting block 1 comprises a platform 5 and an inclined plane 3 to the rear of the platform 5, and a base 9 intended for fixing the starting block 1 to the ground at the edge of a swimming pool. The starting block 1 further comprises a bar-like structure 7 fixed to the base 9 or to the platform 5 on the base 9 of the starting block 1. The supporting ledge device 10 comprises a support plate or ledge 13, which is located in the water and connected, at the ends thereof, by at least one or two flexible straps 11. The supporting ledge device 10 further comprises a means 12 for acting on the one or more straps 11 of the supporting ledge device on the starting block 1, for example placed on the platform 5 in front of the inclined plane 3. Before the competition, the swimmer can still manually adjust the position of the support ledge 13 of the supporting ledge device 10 in the water.

One drawback of such a supporting ledge device 10 is that it has to be placed and adjusted on a starting block 1, which leads to additional mechanical handling operations when mounting each starting block 1. Furthermore, since a judge of a backstroke swimming competition has to come and stow the supporting ledge device 10, in particular remove the support ledge from the water during the race, there is no means of facilitating this task, which constitutes another drawback.

The European patent application No. 3 669 953 A1 describes a swimming starting block, in particular for a backstroke race. A foot support ledge is connected by straps to a member for adjusting the position of the ledge in the water. This adjustment member is a cylinder passing through two opposite side walls of the starting block and with a handling wheel at one end of the cylinder to wind the straps onto the cylinder in a rest position or to place the ledge in a specific position for the swimmer. However, this does not allow the adequate position of the ledge in the water to be quickly adjusted with precision for each swimmer and there is no other means of stowing the ledge out of the water, which can constitute a drawback during a swim race. Moreover, since the member for adjusting the support ledge is not integrated into the starting block, it must still be added thereto before the start of each race, which complicates the handling operations for adapting each starting block.

SUMMARY OF THE INVENTION

The purpose of the invention is thus to overcome the drawbacks of the aforementioned prior art by proposing a supporting ledge device that is integrated into a starting block or into a base plate intended for fixing a starting block to the ground. In this way, the supporting ledge device is quickly installed and easily adjusted to the adequate position by the swimmer. Moreover, no additional parts are required for a backstroke competition.

There is provided a starting block with a supporting ledge device for a start of a backstroke race, and the supporting ledge device is at least partially integrated into the starting block, and the supporting ledge device includes an actuation assembly for placing a support ledge, via at least one fastening element, into a rest position or into one of the positions to be selected for a swimmer towards the rear of a base of the starting block, and the actuation assembly includes return means configured to pull the fastening element and push the support ledge towards the swimming pool, or to push the fastening element and pull the support ledge towards the rest position out of the water.

Of the starting block with a supporting ledge device, the supporting ledge device may be fully integrated inside the starting block in a rest position; the supporting ledge device may include the support ledge on which at least one foot of a swimmer can be supported before the start of a backstroke race, and the support ledge may be held from within or from outside a base of the starting block by two fastening elements respectively fixed to the two ends of the support ledge; in a rest position, the support ledge may be stowed inside a recess in the lower part of the base of the starting block; the supporting ledge device may include two flexible fastening elements in the form of straps respectively connected to the two ends of the support ledge and to return means within the starting block at ends opposite the fixation to the support ledge; each of the straps may pass into a respective longitudinal box of the actuation assembly, each box for passing one of the straps comprising an inlet opening and an outlet opening for the strap having a shape that substantially complements the cross-section of the strap, the strap being guided inside a groove made in the box and connected to one end of a spring or of an elastic band acting as a return means, the other end whereof is fixed in an opposite position in the box so as to prevent the strap from becoming folded when it is pushed or pulled by the spring or the elastic band; there may be a rod connected to the two ends of the straps opposite the fixation to the support ledge disposed at the rear of the starting block that can be manually pulled so as to be placed within a positioning notch of an element with positioning notches or on a hook of a rest element; and when not in the rest position, the straps may be intended to push the support ledge towards the water under the action of the return spring or elastic band in each box.

There is provided a base plate for mounting a starting block to the ground, with a supporting ledge device for a start of a backstroke race, and the supporting ledge device is at least partially integrated into the base plate, and the supporting ledge device includes an actuation assembly for placing a support ledge, via at least one fastening element, into a rest position or into one of the positions to be selected for a swimmer towards the rear of the base plate, and wherein the actuation assembly includes return means intended to pull the fastening element and push the support ledge towards the swimming pool, or to push the fastening element and pull the support ledge towards the rest position out of the water.

Of the base plate intended for fixing a starting block, the supporting ledge device may be fully integrated inside the base plate in a rest position; the supporting ledge device may include the support ledge on which at least one foot of a swimmer can be supported before the start of a backstroke race, the support ledge being held from within or from outside the base plate by two fastening elements respectively fixed to the two ends of the support ledge; in a rest position, the support ledge may be stowed on a fixture at the inlet of the base plate; the supporting ledge device may include two flexible fastening elements in the form of straps respectively connected to the two ends of the support ledge and to return means within the base plate at ends opposite the fixation to the support ledge; each of the straps may pass into a respective longitudinal box of the actuation assembly, and each box for passing one of the straps may include an inlet opening and an outlet opening for the strap having a shape that substantially complements the cross-section of the strap, and the strap may be guided inside a groove made in the box and connected to one end of a spring or of an elastic band acting as a return means, the other end whereof may be fixed in an opposite position in the box so as to prevent the strap from becoming folded when it is pushed or pulled by the spring or the elastic band; a rod may be connected to the two ends of the straps opposite the fixation to the support ledge disposed in a rear position of the base plate that can be manually pulled so as to be placed within a positioning notch of an element with positioning notches or on a hook of a rest element; and when not in the rest position, the straps may be intended to push the support ledge towards the water under the action of the return spring or elastic band in each box.

One advantage of the starting block or of the base plate is that the supporting ledge device is at least partially integrated into the starting block or into the base plate to facilitate the use and stowage thereof without the need for additional handling operations to fix it in place. In this way, the supporting ledge device is quick to install and easily adjusted by the competitor. Then, after the start and during the race, the one or more judges can stow it away quickly and easily.

A further advantage of integrating the supporting ledge device into the starting block or into the base plate is that the integration of the supporting ledge device is more aesthetically pleasing and safer than a non-integrated version of the supporting ledge device.

BRIEF DESCRIPTION OF THE FIGURES

The purposes, advantages and features of the starting block or of the base plate with a supporting ledge device will appear more clearly after reading the following description given of non-limiting embodiments and illustrated by the drawings in which.

DETAILED DESCRIPTION OF THE INVENTION

In the following description, the well-known elements of a starting block or of a base plate for a starting block, with a supporting ledge device used for the start of a backstroke swimming competition, will only be described in a simplified manner.

Figure 2:
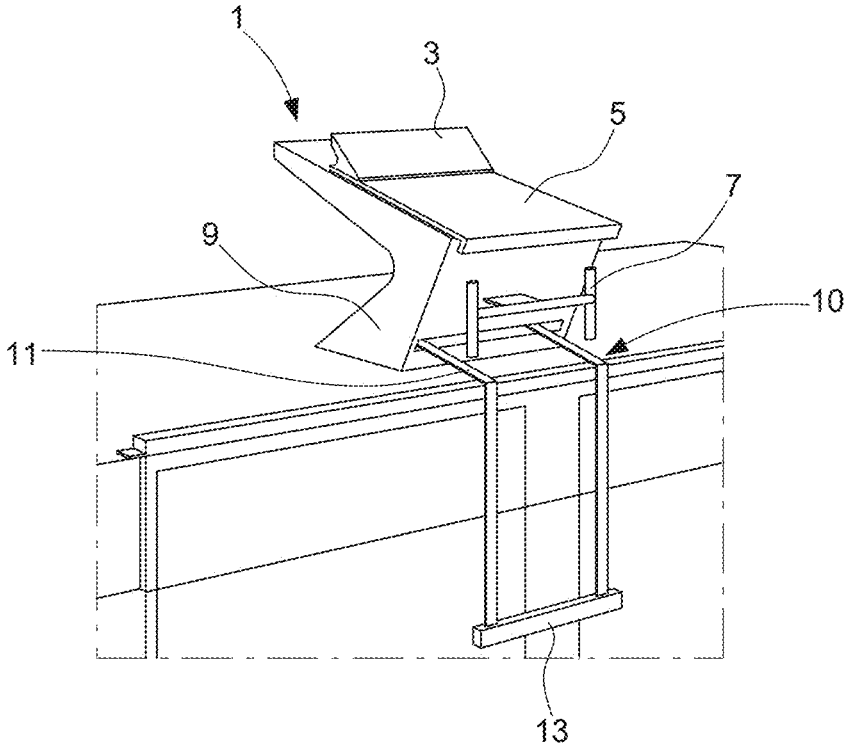
FIG. 2 shows a first embodiment of the starting block with a supporting ledge device that is at least partially integrated into the starting block according to the invention.

FIG. 2 shows a first embodiment of the starting block 1 with a supporting ledge device 10. As previously mentioned, the supporting ledge device 10 is at least partially integrated into the starting block 1. The starting block 1 comprises a base 9, the lower part whereof can be fixed either to a ground around a swimming pool as shown in FIG. 2, or to a base plate intended to be fixed to the ground and on which the starting block 1 is mounted. In this embodiment, the supporting ledge device 10 is shown fully extended out of the starting block and mainly in the lower part of the base 9 of the starting block 1.

The supporting ledge device 10 in particular comprises a support plate or ledge 13 which, in a rest position, can be stowed inside a recess in the lower part of the base 9. The support plate or ledge 13 is held from the inside or outside of the base 9 of the starting block 1 by at least one fastening element 11 and preferably by a plurality of fastening elements 11, for example two fastening elements fixed respectively to the two ends of the support plate or ledge 13. This support plate or ledge 13 can be made of a solid material, for example a plastic material. The fastening elements 11 are preferably flexible. These can be straps similar to car seat belts, or a chain preferably made of a non-metallic material, or various other flexible fastening means.

The one or more fastening elements 11 connected to return means of an actuation assembly of the supporting ledge device can be envisaged within the base 9 as explained hereinbelow in FIGS. 5*a* and 5*b* of a preferred embodiment. These return means can consist of either one or two elastic bands or one or two return springs, for which one end of each elastic band or spring is fixed, whereas the other end of each elastic band or spring is connected or fixed respectively to each fastening element 11. Mainly in a rest position, each rubber band or spring is tensioned with a certain return force. Each elastic band or spring is intended to push each fastening element 11 with a certain return force until the support ledge 13 is placed in the water.

Figure 4:
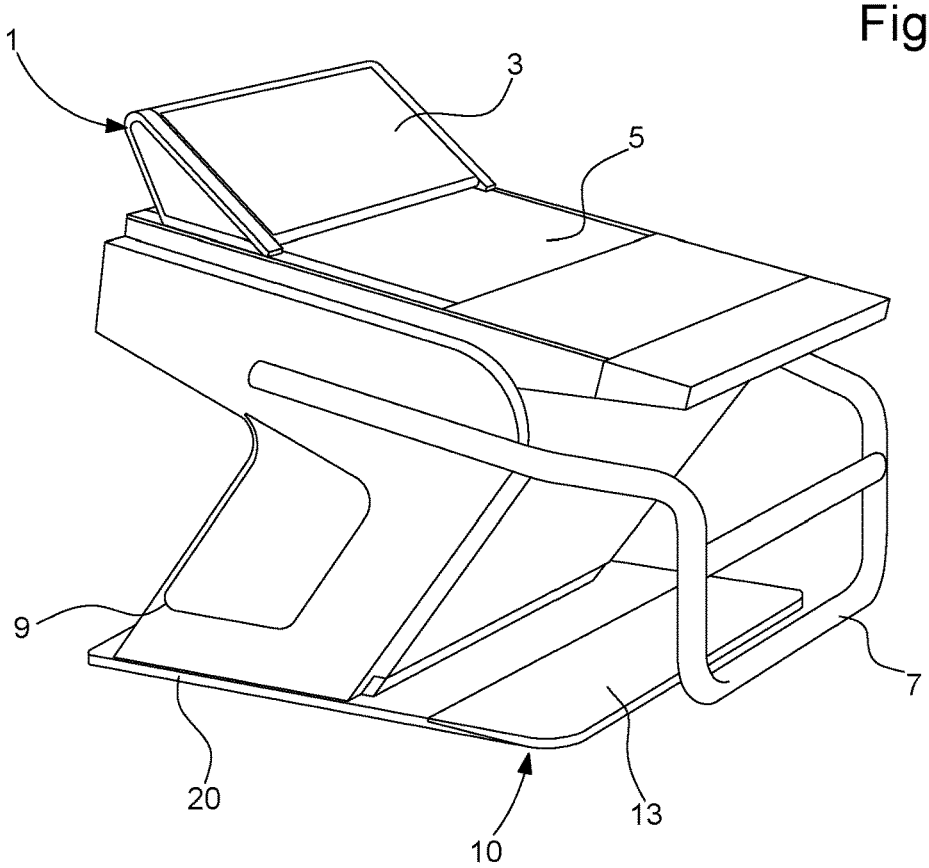
FIG. 4 shows a first embodiment of a base plate for mounting the starting block, with the supporting ledge device at least partially integrated into the base plate according to the invention.

The actuation assembly of the supporting ledge device 10 is mounted at least partially inside the starting block 1 or in the base plate shown in FIG. 4 with a position adjuster disposed on a rear side of the base 9 of the starting block 1 or of the base plate. It can also be possible to have at least a part of the actuation assembly fixed to side and rear walls of the base 9 of the starting block.

Figure 1:
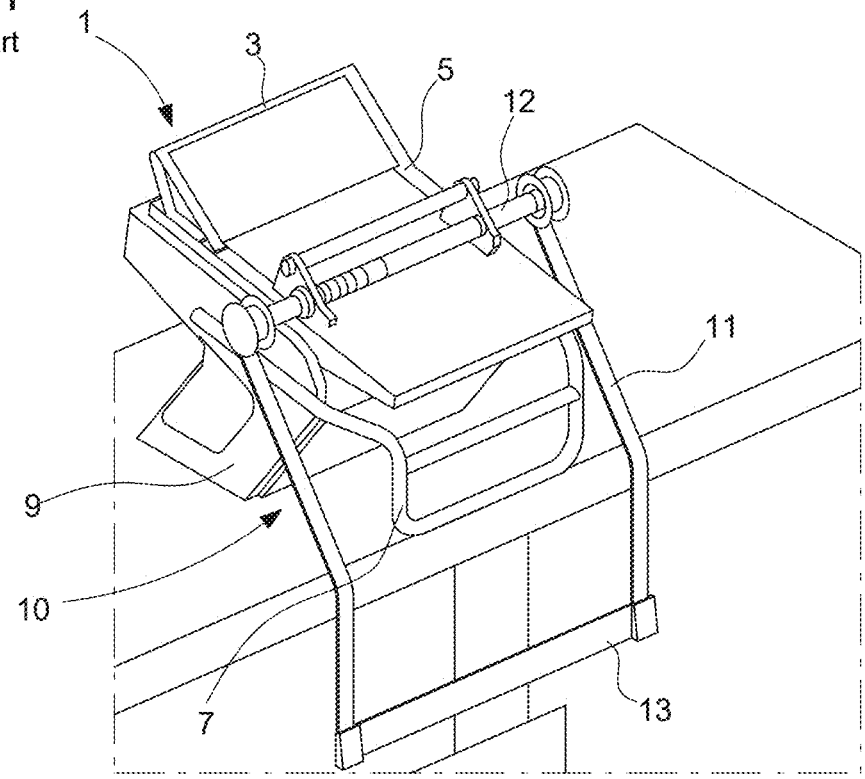
Fig. 1 related art
FIG. 1 shows a starting block with a supporting ledge device according to the prior art.

As shown in FIG. 2, the upper part of the base 9 comprises a platform 5, a support element 3 with an inclined plane, which is disposed on the rear part of the platform 5. The starting block 1 further comprises a bar-like structure 7 fixed to the base 9, which extends towards the front of the starting block 1 so as to be gripped by the swimmers hands for a backstroke race. As shown in the previous FIG. 1, this metal bar structure 7 must preferably comprise two horizontal bars connected, at the ends thereof, by two vertical bars, which are extended towards the starting block 1 by two more or less rectilinear bars on either side of the base 9 so as to be fixed, at the end thereof, to said base 9 of the starting block 1.

After the start of the backstroke race and during the race, the supporting ledge device 10 can be stowed or placed in a rest position by a manual action carried out by the one or more judges. The manner in which the supporting ledge device 10 is placed in a rest position is explained hereinbelow with reference to FIGS. 5*a* and 5*b* of the preferred embodiment. In order for the race to run smoothly, it is important that the support ledge 13 is removed from the water to avoid any hindrances, possible injuries or other inconveniences.

Figure 3:
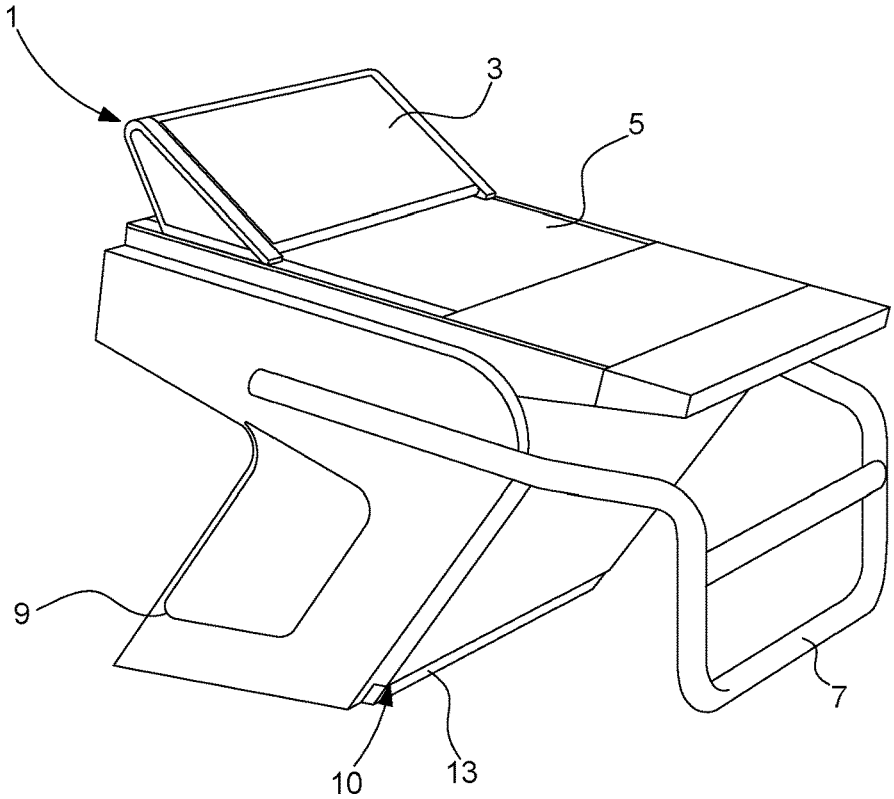
FIG. 3 shows a second embodiment of the starting block with a supporting ledge device that is at least partially integrated into the starting block according to the invention.

FIG. 3 shows a second embodiment of the starting block 1 with the supporting ledge device 10 that is at least partially integrated into the starting block 1. Most of the elements already described with reference to FIG. 2 will not be described again for simplicity reasons. Instead, only the new elements and the functions thereof in the starting block 1 will be described.

The starting block 1 comprises a bar-like structure 7 fixed to the base 9, which extends towards the front of the starting block 1 so as to be gripped by the competing swimmer's hands. This metal bar structure 7 is shown with two horizontal bars connected, at the ends thereof, by two vertical bars, which are extended towards the starting block 1 by two more or less rectilinear bars on either side of the base 9 so as to be fixed, at the end thereof, to said base 9 of the starting block 1.

The supporting ledge device 10 is shown in FIG. 3 in the rest position with the support plate 13 stowed in an inlet recess made in the bottom of the base 9 of the starting block 1.

Preferably, there can be an elastic band or a return spring as explained with reference to FIGS. 5*a* and 5*b* hereinbelow to automatically eject the support ledge 13 into the water for at least the position selected from in particular 5 defined positions (+4 cm, +2 cm, 0, −2 cm, −4 cm).

It is further noted that electronic means, not shown, can be provided in a part of the starting block 1 to signal a reaction time of the swimmer when the starting signal is given in order to be able to detect any false start by monitoring the time difference between the starting signal and the actual start of the swimmer. For this purpose, in connection with the electronic signal processing means, strain gauges or force sensors can be provided in connection with the bar-like structure 7 gripped by the swimmer or optionally the force exerted on the support ledge 13 at the start time.

FIG. 4 shows a base plate 20 to be fixed to the ground at the edge of a swimming pool, and on which the starting block 1 is mounted and fixed. In this case, none of the same elements already described with reference to FIGS. 2 and 3 will be described again. It should be noted that the supporting ledge device 10 can also be in a rest position with the support ledge 13 disposed on an inlet support of the base plate 20. The supporting ledge device 10 can be placed in a stowed rest position as preferably explained with reference to FIGS. 5*a* and 5*b* hereinbelow.

In the embodiments shown in FIGS. 2 to 4, the supporting ledge device 10 in the rest position can be considered to be fully integrated inside the starting block 1 or inside the base plate 20 or partially exiting the rear of the base plate.

Figure 5A:
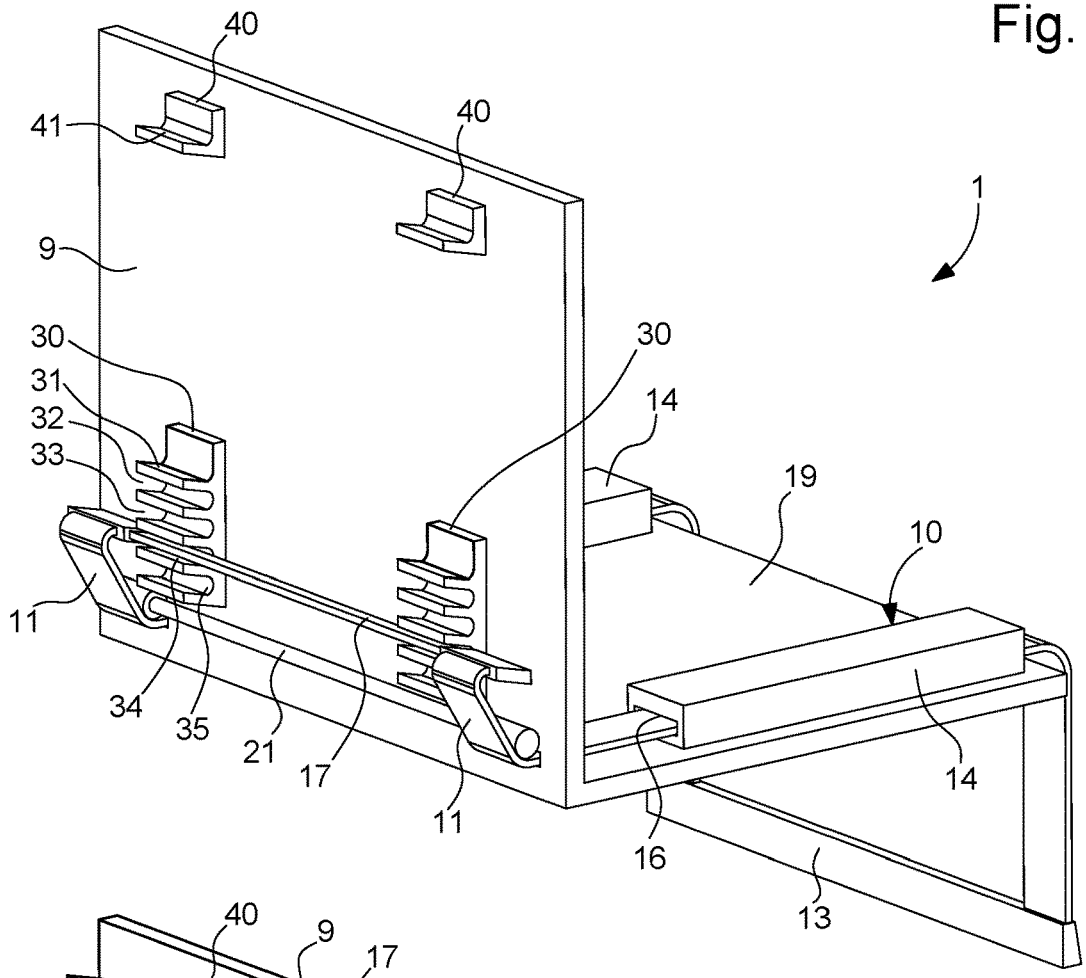
FIGS. 5*a* and 5*b* show a detailed embodiment of the supporting ledge device for a backstroke start that is at least partially integrated into the starting block with adjustable selection positions for the swimmer in FIG. 5*a* and a rest position with the support ledge out of the water in FIG. 5*b* according to the invention.
Figure 5B:
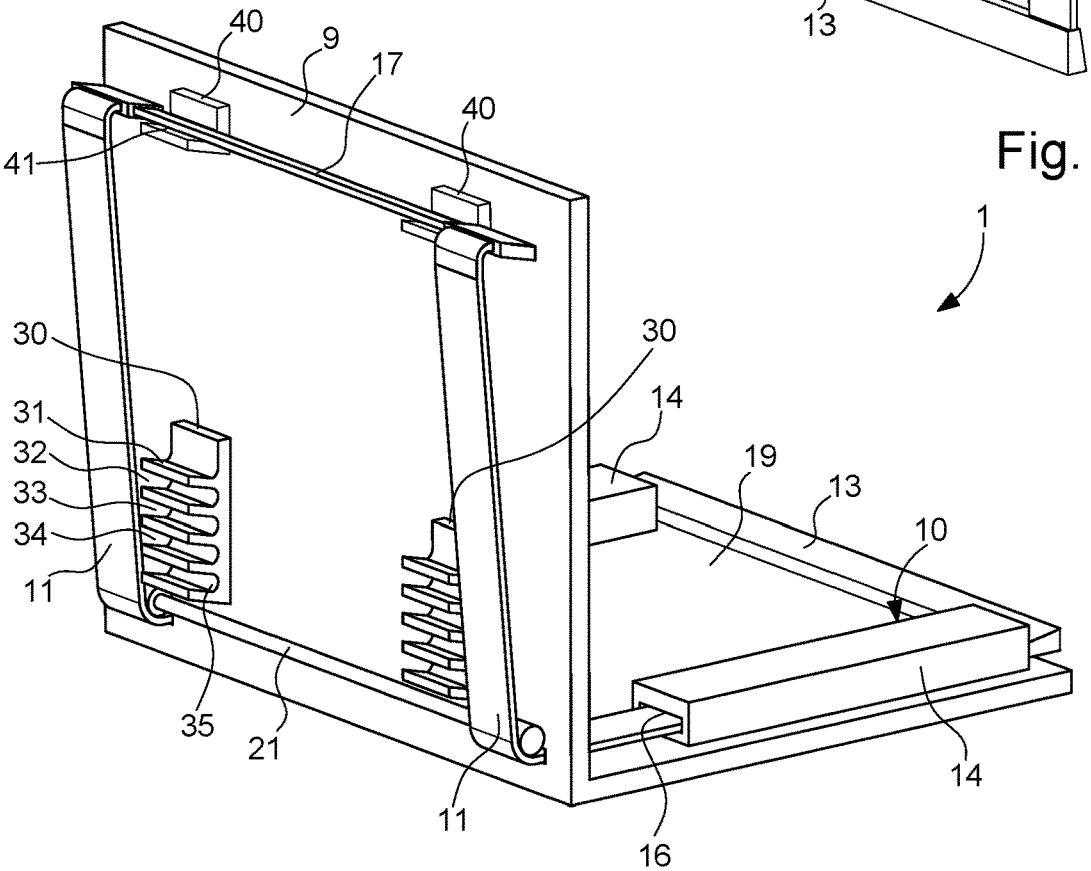

FIGS. 5*a* and 5*b* show a preferred embodiment of the supporting ledge device 10 for a backstroke start.

FIG. 5*a* shows the positioning of the support ledge 13 by means of at least one element 30 with positioning notches of an actuation assembly of the supporting ledge device 10. In the case shown, two elements 30 with positioning notches are provided if two fastening elements 11 are used, which are two flexible straps 11. A first end of the first strap 11 is fixed respectively to a first end of the support ledge 13, whereas the first end of the second strap 11 is fixed respectively to a second end of the support ledge 13, which is opposite the first end of the support ledge 13.

Each second end of the straps 11 is fixed to one of the two respective ends of a positioning rod 17. As it is intended to place the positioning and resting elements of the supporting ledge device 10 on a rear side of the base 9 of the starting block 1, each element 30 with positioning notches is preferably disposed on a rear outer wall of the base 9 of the starting block 1. In such a case, five adjustment positions are provided for adjusting the position of the support ledge 13, i.e. +4 cm (31), +2 cm (32), 0 (33), −2 cm (34) and −4 cm (35). In this case, a substantially parallelepipedal starting block 1 is preferable, where only the rear wall and the bottom wall 19 of the base 9 are shown in FIGS. 5*a* and 5*b* to clearly show all of the components of the actuation assembly of the device with the support ledge 13. However, at least the front and rear walls of the base 9 can still be inclined towards the rear of the starting block 1.

When the race has started, at least one judge can come and pull the positioning rod 17 towards at least one resting element 40 having a hook 41 to retain the rod 17 and bring the device 10 with the support ledge 13 to rest out of the water against the base of the front wall of the starting block 1. By pulling the rod 17 upwards towards the rest position, a certain force must be applied to the rod against a return spring or an elastic band, disposed in at least one pass-through box 14 for at least one strap 11. This return spring or elastic band can be fixed to an inlet of the box 14 on the front side, whereas the other end of the return spring or elastic band is fixed to the strap 11. The elastic band or return spring is used to allow the support ledge 13 to be ejected towards the water either into the selected position or when the rod 17 is at the outlet of the rear outer wall of the base 9 below the element 30 with positioning notches.

Preferably two boxes 14 are provided for the respective passage of each strap 11. Each of the boxes 14 is, for example, fixed inside the starting block 1 on a base plate 19, such that each strap 11 of each box 14 is passed in a rectilinear direction.

As will be described in FIGS. 6*a* and 6*b*, each strap 11 enters through an opening 16 which is slightly larger than the cross-section of each strap, but which has a substantially equivalent rectangular shape. In the box 14 for passing one of the straps 11, said strap 11 is guided inside a groove 25 of a complementary shape made in the box 14. This is necessary in order to be able to eject the support ledge 13 into to a determined position in the water without the strap bending in the box 14 when the elastic band or the return spring pulls each strap 11 forwards from the starting block 1. Each strap 11 exits through an outlet opening in the box of the same size as the inlet opening 16. It goes without saying that the size of the box is adapted to the path that each strap takes from the rest position to the fully released position at the bottom of the rear wall of the base 9. In one embodiment shown in FIGS. 6*a* and 6*b*, each strap 11 can pass through an opening 22 in the rear wall of the base 9 while being guided out by, for example, a pin 21 to prevent any problems of damage being caused to each strap 11. The pin 21 is rotatably mounted or fixed above the outlet openings 22 for the straps 11 in the rear wall of the base 9.

In an alternative embodiment not shown and as a function of the size of the base 9 of the starting block 1, the boxes 14 for passing the straps 11 can be fixed to the side walls outside the base 9. This further avoids the need to make openings 22 for the passage of each strap 11 through the rear wall of the base 9 and also avoids the need to place a strap guide pin 21 behind the rear wall of the base 9.

Figure 6A:
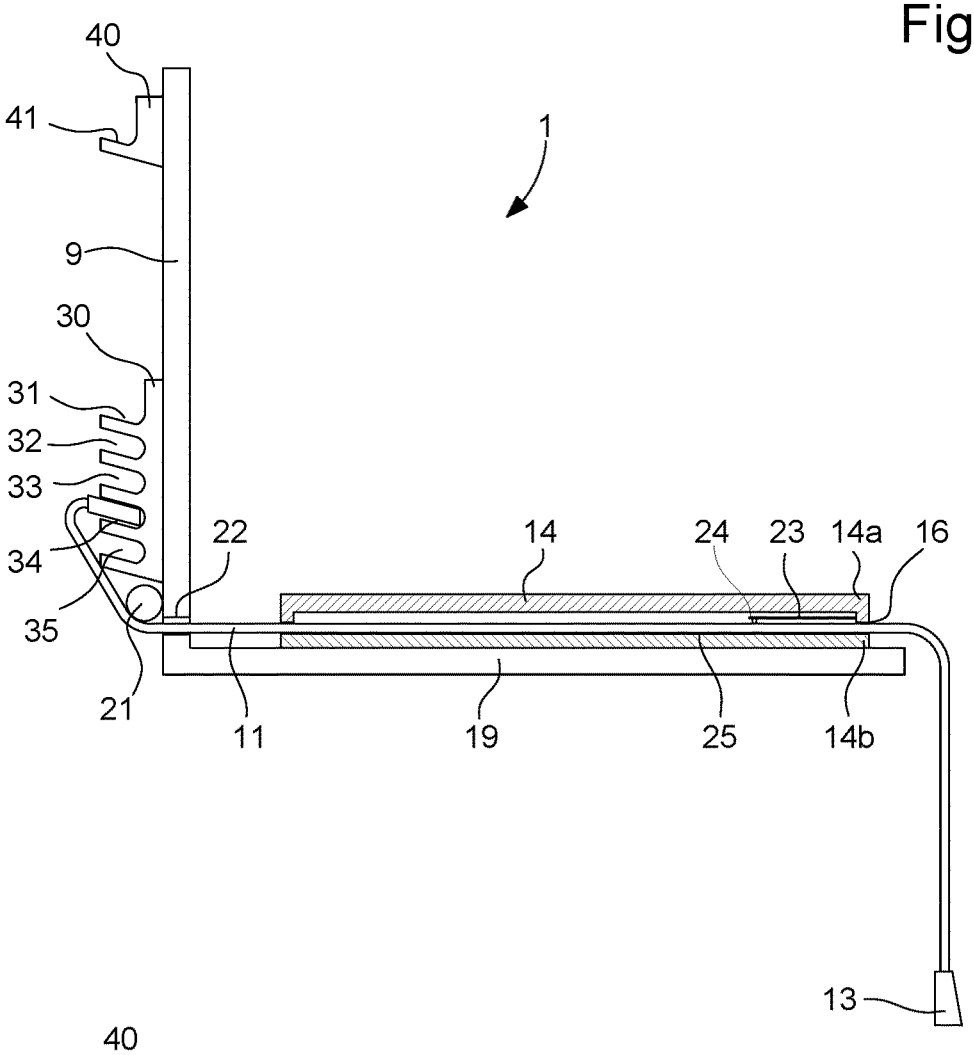
FIGS. 6*a* and 6*b* show the elastic band or spring box for pulling or pushing the one or more straps towards the water out of the adjustable selection positions and the rest position according to the invention.
Figure 6B:
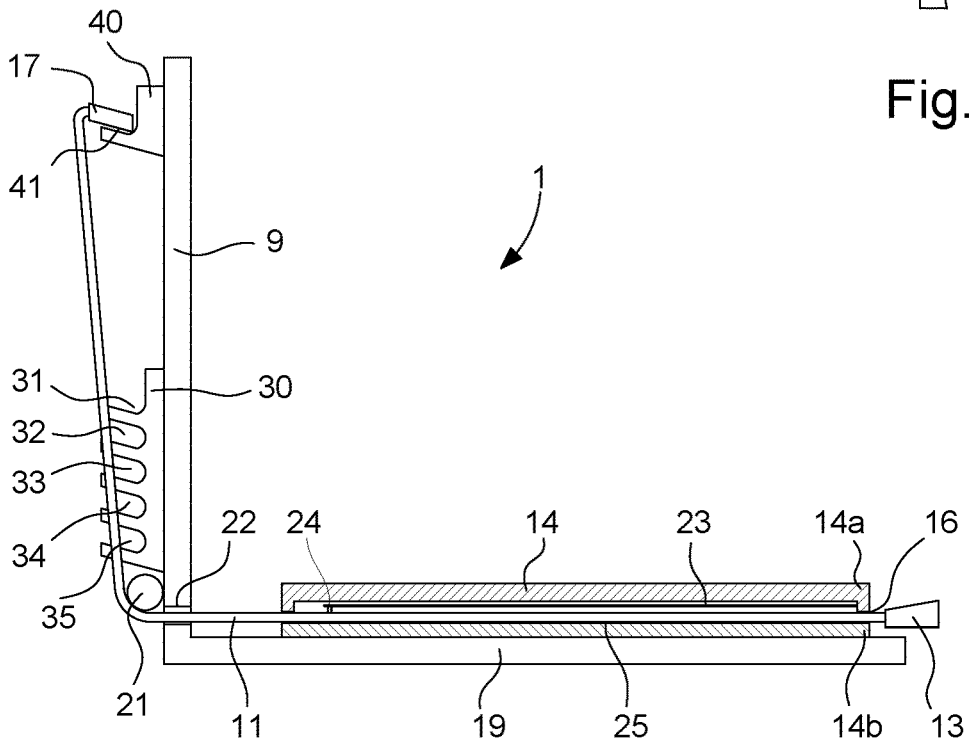

FIGS. 6*a* and 6*b* show one of the two boxes 14 for passing one of the straps 11 shown via a longitudinal sectional view. It should be noted that the spring 23, or elastic band, is fixed to one end of the box and is connected in the position 24 to a portion of the strap disposed in the groove 25 thereof. The box 14 can be in two parts 14*a*, 14*b* in order to facilitate the passage of the strap 11 and the fixing of the spring 23 or of the elastic band, where one of the parts 14*b* comprises the groove 25 housing the strap 11 as it passes with the part 14*a* closing the groove 25 a little so as to prevent the strap 11 from becoming folded when the return spring 23 or the elastic band in some cases pushes the end of the support ledge 13 towards the water and into the selected position.

Figure 7:
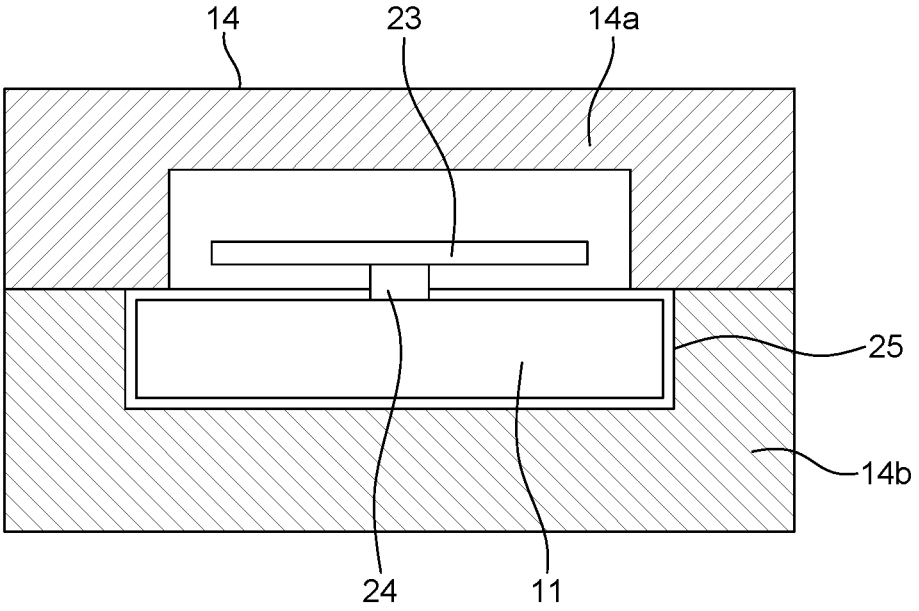
FIG. 7 shows a cross-section at the inlet of a strap pass-through box and towards the outlet to the support ledge in FIG. 6*a*.

FIG. 7 shows in more detail the internal shape of the box 14 for passing one of the straps 11. Since a flexible strap 11 is needed that does not become folded under the action of the tension spring pushing the support ledge 13 into the water, the part 14*b* can be fixed to the bottom wall 19 of the base 9. The part 14*b* thus comprises a groove 25 of greater width than a strap 11 and disposed along virtually the entire length of the box as far as the openings for passing the straps. The part 14*a* comprises an edge of greater width than the edge of the part 14*b* with a groove 25, so as to slightly cover the groove 25 so that the strap 11 does not become folded under the action of the spring or of the elastic band. The part 14*a* can be fixed to the part 14*b* by any known mechanical means, such as a set of screws and threaded bores, or by bonding.

The box 14 can also be made in one piece, but the mounting of the spring 23 and of the strap 11 in this case becomes difficult.

Depending on the placement of the return means inside the boxes, the swimmer can also pull the support ledge into a desired position for his/her race. In this precise case, positioning notches can be provided to lock the position selected by the swimmer.

The entire arrangement described for the starting block can be adapted to the base plate according to the same principle.

From the above description, several alternative embodiments of the starting block and of the base plate for a starting block having a supporting ledge device at least partially integrated into the starting block or into the base plate can be produced, without departing from the scope defined by the claims.

The invention claimed is:

1. A starting block (1) with a supporting ledge device (10) for a start of a backstroke race, wherein the supporting ledge device (10) is at least partially integrated into the starting block, wherein the supporting ledge device (10) comprises an actuation assembly for placing a support ledge (13), via at least one fastening element (11), into a rest position or into one of the positions to be selected for a swimmer towards the rear of a base (9) of the starting block (1), and wherein the actuation assembly comprises return means, through which the fastening element (11) is routed, configured to pull the fastening element (11) and push the support ledge (13) towards the swimming pool as a length of the fastening element (11) within the return means remains constant, or to push the fastening element (11) and pull the support ledge (13) towards the rest position out of the water as the length of the fastening element (11) within the return means remains constant.

2. The starting block (1) according to claim 1, wherein the supporting ledge device (10) is fully integrated inside the starting block in a rest position.

3. The starting block (1) according to claim 1, wherein the supporting ledge device (10) comprises the support ledge (13) on which at least one foot of a swimmer can be supported before the start of a backstroke race, the support ledge (13) being held from within or from outside a base (9) of the starting block (1) by two fastening elements (11) respectively fixed to the two ends of the support ledge (13).

4. The starting block (1) according to claim 3, wherein in a rest position, the support ledge (13) is stowed inside a recess in the lower part of the base (9) of the starting block (1).

5. The starting block (1) according to claim 3, wherein the supporting ledge device (10) comprises two flexible fastening elements (11) in the form of straps respectively connected to the two ends of the support ledge (13) and to return means within the starting block at ends opposite the fixation to the support ledge (13).

6. The starting block (1) according to claim 5, wherein each of the straps (11) pass into a respective longitudinal box (14) of the actuation assembly, each box for passing one of the straps comprising an inlet opening (16) and an outlet opening for the strap having a shape that substantially complements the cross-section of the strap (14), the strap (11) being guided inside a groove (25) made in the box (14) and connected to one end of a spring (23) or of an elastic band acting as a return means, the other end whereof is fixed in an opposite position in the box (14) so as to prevent the strap from becoming folded when it is pushed or pulled by the spring (23) or the elastic band.

7. The starting block (1) according to claim 6, wherein a rod (17) connected to the two ends of the straps opposite the fixation to the support ledge (13) disposed at the rear of the starting block (1) can be manually pulled so as to be placed within a positioning notch of an element (30) with positioning notches or on a hook (41) of a rest element (40).

8. The starting block (1) according to claim 7, wherein when not in the rest position, the straps (11) are intended to push the support ledge (13) towards the water under the action of the return spring (23) or elastic band in each box (14).

9. A base plate (20) for mounting a starting block (1) to the ground, with a supporting ledge device (10) for a start of a backstroke race, wherein the supporting ledge device (10) is at least partially integrated into the base plate (20), wherein the supporting ledge device (10) comprises an actuation assembly for placing a support ledge (13), via at least one fastening element (11), into a rest position or into one of the positions to be selected for a swimmer towards the rear of the base plate (20), and wherein the actuation assembly comprises return means, through which the fastening element (11) is routed, configured to pull the fastening element (11) and push the support ledge (13) towards the swimming pool as a length of the fastening element (11) within the return means remains constant, or to push the fastening element (11) and pull the support ledge (13) towards the rest position out of the water as the length of the fastening element (11) within the return means remains constant.

10. The base plate (20) according to claim 9, wherein the supporting ledge device (10) is fully integrated inside the base plate in a rest position.

11. The base plate (20) according to claim 9, wherein the supporting ledge device (10) comprises the support ledge (13) on which at least one foot of a swimmer can be supported before the start of a backstroke race, the support ledge (13) being held from within or from outside the base plate (20) by two fastening elements (11) respectively fixed to the two ends of the support ledge (13).

12. The base plate (20) according to claim 11, wherein in a rest position, the support ledge (13) is stowed on a fixture at the inlet of the base plate (20).

13. The base plate (20) according to claim 11, wherein the supporting ledge device (10) comprises two flexible fastening elements (11) in the form of straps respectively connected to the two ends of the support ledge (13) and to return means within the base plate at ends opposite the fixation to the support ledge (13).

14. The base plate (20) according to claim 13, wherein each of the straps (11) pass into a respective longitudinal box (14) of the actuation assembly, each box for passing one of the straps comprising an inlet opening (16) and an outlet opening for the strap having a shape that substantially complements the cross-section of the strap (11), the strap (11) being guided inside a groove (25) made in the box (14) and connected to one end of a spring (23) or of an elastic band acting as a return means, the other end whereof is fixed in an opposite position in the box (14) so as to prevent the strap (11) from becoming folded when it is pushed or pulled by the spring (23) or the elastic band.

15. The base plate (20) according to claim 13, wherein a rod (17) connected to the two ends of the straps (11) opposite the fixation to the support ledge (13) disposed in a rear position of the base plate (20) can be manually pulled so as to be placed within a positioning notch of an element (30) with positioning notches or on a hook (41) of a rest element (40).

16. The base plate (20) according to claim 15, wherein when not in the rest position, the straps (11) are intended to push the support ledge (13) towards the water under the action of the return spring (23) or elastic band in each box (14).

17. The starting block (1) according to claim 1, wherein the return means comprises an inlet opening (16) and an outlet opening, and the fastening element (11) is routed flatly through the return means from the inlet opening (16) to the outlet opening.

18. The starting block (1) according to claim 17, wherein the return means comprises a longitudinal box (14) having the inlet opening (16), at a first longitudinal end of the longitudinal box (14), and the outlet opening at a second longitudinal end of the longitudinal box (14), the first longitudinal end being opposite to the second longitudinal end along a length of the longitudinal box (14).

19. The starting block (1) according to claim 18, wherein the longitudinal box (14) further comprises a first part (14*a*), that is a top of the longitudinal box (14), and a second part (14*b*), that is a bottom of the longitudinal box (14), the second part (14*b*) is, as the bottom of the longitudinal box (14), arranged in direct contact with a bottom wall (19) of the base (9) of the starting block (1) along an entire length of the second part (14*b*), and the longitudinal box (14) further comprises a spring (23) attached to the fastening element (11) and configured to exert a pulling force on the fastening element (11) in a direction through the inlet opening (16) and towards the outlet opening.

20. The starting block (1) according to claim 19, wherein the spring (23) is arranged between first inner walls of the first part (14*a*) that is the top of the longitudinal box (14), the fastening element (11) is partly arranged between second inner walls of the second part (14*b*) that is the bottom of the longitudinal box (14), and the first inner walls are closer to each other than are the second inner walls to each other.

* * * * *